US011605326B2

(12) United States Patent
Hong et al.

(10) Patent No.: US 11,605,326 B2
(45) Date of Patent: Mar. 14, 2023

(54) DISPLAY PANEL

(71) Applicant: WUHAN CHINA STAR OPTOELECTRONICS TECHNOLOGY CO., LTD., Hubei (CN)

(72) Inventors: Guanghui Hong, Hubei (CN); Jingfeng Xue, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 885 days.

(21) Appl. No.: 16/477,685

(22) PCT Filed: Jan. 22, 2019

(86) PCT No.: PCT/CN2019/072600
§ 371 (c)(1),
(2) Date: Jul. 12, 2019

(87) PCT Pub. No.: WO2020/042533
PCT Pub. Date: Mar. 5, 2020

(65) Prior Publication Data

US 2021/0358363 A1 Nov. 18, 2021

(30) Foreign Application Priority Data

Aug. 31, 2018 (CN) ..... 201811009154.1

(51) Int. Cl.
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/06* (2013.01)

(58) Field of Classification Search
None
See application file for complete search history.

(56) References Cited

U.S. PATENT DOCUMENTS

2017/0092171 A1* 3/2017 Knausz ..... G06F 3/041
2018/0197466 A1* 7/2018 Roh ..... G09G 3/3208

FOREIGN PATENT DOCUMENTS

| | | | |
|---|---|---|---|
| CN | 1952765 | A | 4/2007 |
| CN | 102682687 | A | 9/2012 |
| CN | 104112423 | A | 10/2014 |
| CN | 106601164 | A | 4/2017 |
| CN | 108877637 | A | 11/2018 |
| JP | 2017227755 | A | 12/2017 |

* cited by examiner

*Primary Examiner* — Ifedayo B Iluyomade

(57) ABSTRACT

A display panel is disclosed. The display panel includes a de-multiplexing switch group, a signal transmission line, a first control line, and a second control line. The first control line and the second control line are connected to the de-multiplexing switch group. Voltage levels of signals of the first control line and the second control line are opposite to each other, and a number of groups of the first control line and the second control line which intersect the signal transmission line is greater than or equal to zero. Pictures of display panels can be prevented from being affected by intersections of lines.

14 Claims, 7 Drawing Sheets

DISPLAY PANEL

BACKGROUND OF DISCLOSURE

1. Field of Disclosure

The present disclosure relates to the field of display technology, and more particularly, to a display panel.

2. Description of Related Art

In conventional display panels, de-multiplexing circuits are generally used to de-multiplex data signals generated from data driving circuits and to input the de-multiplexed data signals to a pixel array.

In implementation of conventional technology, inventors of the present disclosure have found at least the following problems:

Because of intersections of signal lines, which transmit the de-multiplexed data signals and control lines, which control the de-multiplexing circuits, the de-multiplexed data signals in the signal lines are affected by control signals transmitted by the control lines, causing pictures displayed by display panels to be affected.

Therefore, it is necessary to provide a novel technical solution to solve the above technical problems.

SUMMARY

The object of the present disclosure is to provide a display panel which can prevent pictures displayed by display panels from being affected by derived pulse signals generated from intersections of signal transmission lines and a control line group used to control de-multiplexing switches.

In order to solve the above problems, the present disclosure provides technical solutions as follows:

A display panel, including: a pixel array including at least one pixel column; a data driving circuit including at least one data line; a scan driving circuit connected to the pixel array; and a de-multiplexing circuit connected to the pixel array and to the data line, the de-multiplexing circuit including: a de-multiplexing switch group connected to the data line; a signal transmission line, wherein two ends of the signal transmission line are connected to the de-multiplexing switch group and the at least one pixel column respectively; and a control line group connected to the de-multiplexing switch group, wherein the control line group includes a first control line and a second control line, wherein voltage levels of a first control signal and a second control signal transmitted by the first control line and the second control line respectively are opposite to each other, and wherein a number of control line groups that intersect the signal transmission line is greater than or equal to zero; wherein the control line group is disposed at a side of the de-multiplexing switch group, near the pixel array, and/or at a side of the de-multiplexing switch group, away from the pixel array; and wherein the second control signal is at a low voltage level when the first control signal is at a high voltage level, and the second control signal is at the high voltage level when the first control signal is at the low voltage level.

In the above display panel, in response that the number of control line groups that intersect the signal transmission line is greater than zero, the intersection of the signal transmission line and the control line group is located at the side of the de-multiplexing switch group, near the pixel array.

In the above display panel, the number of control line groups is two or three.

In the above display panel, one of two control line groups has a high voltage level waveform and a low voltage level waveform delayed for a predetermined time relative to the other one of the two control line groups.

In the above display panel, the first control signal and the second control signal, with opposite voltage levels, are used to balance a correlation between data signals, transmitted by the data line, due to the intersection of the signal transmission line and the control line group.

A display panel, including: a pixel array including at least one pixel column; a data driving circuit including at least one data line; a scan driving circuit connected to the pixel array; and a de-multiplexing circuit connected to the pixel array and to the data line, the de-multiplexing circuit including: a de-multiplexing switch group connected to the data line; a signal transmission line, wherein two ends of the signal transmission line are connected to the de-multiplexing switch group and the at least one pixel column respectively; and a control line group connected to the de-multiplexing switch group, wherein the control line group includes a first control line and a second control line, wherein voltage levels of a first control signal and a second control signal transmitted by the first control line and the second control line respectively are opposite to each other, and wherein a number of control line groups that intersect the signal transmission line is greater than or equal to zero.

In the above display panel, the control line group is disposed at a side of the de-multiplexing switch group, near the pixel array, and/or at a side of the de-multiplexing switch group, away from the pixel array.

In the above display panel, in response that the number of control line groups that intersect the signal transmission line is greater than zero, the intersection of the signal transmission line and the control line group is located at the side of the de-multiplexing switch group, near the pixel array.

In the above display panel, the number of control line groups is two or three.

In the above display panel, in response that the number of control line groups is three, a control line group is disposed at the side of the de-multiplexing switch group, near the pixel array, and two control line groups are disposed at the side of the de-multiplexing switch group, away from the pixel array.

In the above display panel, in response that the number of control line groups is three, two control line groups are disposed at the side of the de-multiplexing switch group, near the pixel array, and a control line group is disposed at the side of the de-multiplexing switch group, away from the pixel array.

In the above display panel, in response that the number of control line groups is three, a number of control line groups disposed at the side of the de-multiplexing switch group, near the pixel array, is zero, and three control line groups are disposed at the side of the de-multiplexing switch group, away from the pixel array.

In the above display panel, in response that the number of control line groups is two, a control line group is disposed at the side of the de-multiplexing switch group, near the pixel array, and a control line group is disposed at the side of the de-multiplexing switch group, away from the pixel array.

In the above display panel, in response that the number of control line groups is two, a number of control line groups disposed at the side of the de-multiplexing switch group, near the pixel array, is zero, and two control line groups are disposed at the side of the de-multiplexing switch group, away from the pixel array.

In the above display panel, the first control signal and the second control signal, with opposite voltage levels, are used to balance a correlation between data signals, transmitted by the data line, due to the intersection of the signal transmission line and the control line group.

In the above display panel, the de-multiplexing switch group includes a first de-multiplexing switch and a second de-multiplexing switch, wherein a first control end of the first de-multiplexing switch is connected to the first control line; wherein a second control end of the second de-multiplexing switch is connected to the second control line; wherein a first input end of the first de-multiplexing switch and a second input end of the second de-multiplexing switch are both connected to the data line; and wherein a first output end of the first de-multiplexing switch and a second output end of the second de-multiplexing switch are both connected to an end of the signal transmission line.

In the above display panel, the first de-multiplexing switch and the second de-multiplexing switch are configured to turn on or turn off at the same time in response that the voltage levels of the first control signal and the second control signal are opposite to each other.

In the above display panel, the first de-multiplexing switch is turned on when the first control signal is at a high voltage level, and the first de-multiplexing switch is turned off when the first control signal is at the low voltage level; and the second de-multiplexing switch is turned off when the second control signal is at a high voltage level, and the second de-multiplexing switch is turned on when the second control signal is at the low voltage level.

In the above display panel, the second control signal is at a low voltage level when the first control signal is at a high voltage level, and the second control signal is at the high voltage level when the first control signal is at the low voltage level.

In the above display panel, one of two control line groups has a high voltage level waveform and a low voltage level waveform delayed for a predetermined time relative to the other one of the two control line groups.

In the present disclosure, as opposed to conventional technologies, because the voltage levels of the first control signal and the second control signal transmitted by the first control line and the second control line respectively are opposite to each other, and a number of control line groups that intersect the signal transmission line is greater than or equal to zero, a first derived pulse signal, which is resulted in the signal transmission line and which corresponds to the first control signal, is offset by a second derived pulse signal corresponding to the second control signal. Thus, pictures displayed by display panels can be prevented from being affected by derived pulse signals generated from intersections of signal transmission lines and a control line group used to control de-multiplexing switches.

In order to make the above content of the disclosure more apparent and easier to understand. Preferred embodiments in combination with appended drawings are especially illustrated in detail hereunder.

DETAILED DESCRIPTION OF EMBODIMENTS

The term "embodiment" used in the description means an example, an illustration, or an instance. In addition, a definite article "one" used in the description and the appended claims can be generally explained as "one or more" unless being designated additionally or unless being clearly confirmed as singular from its context.

Figure 1:
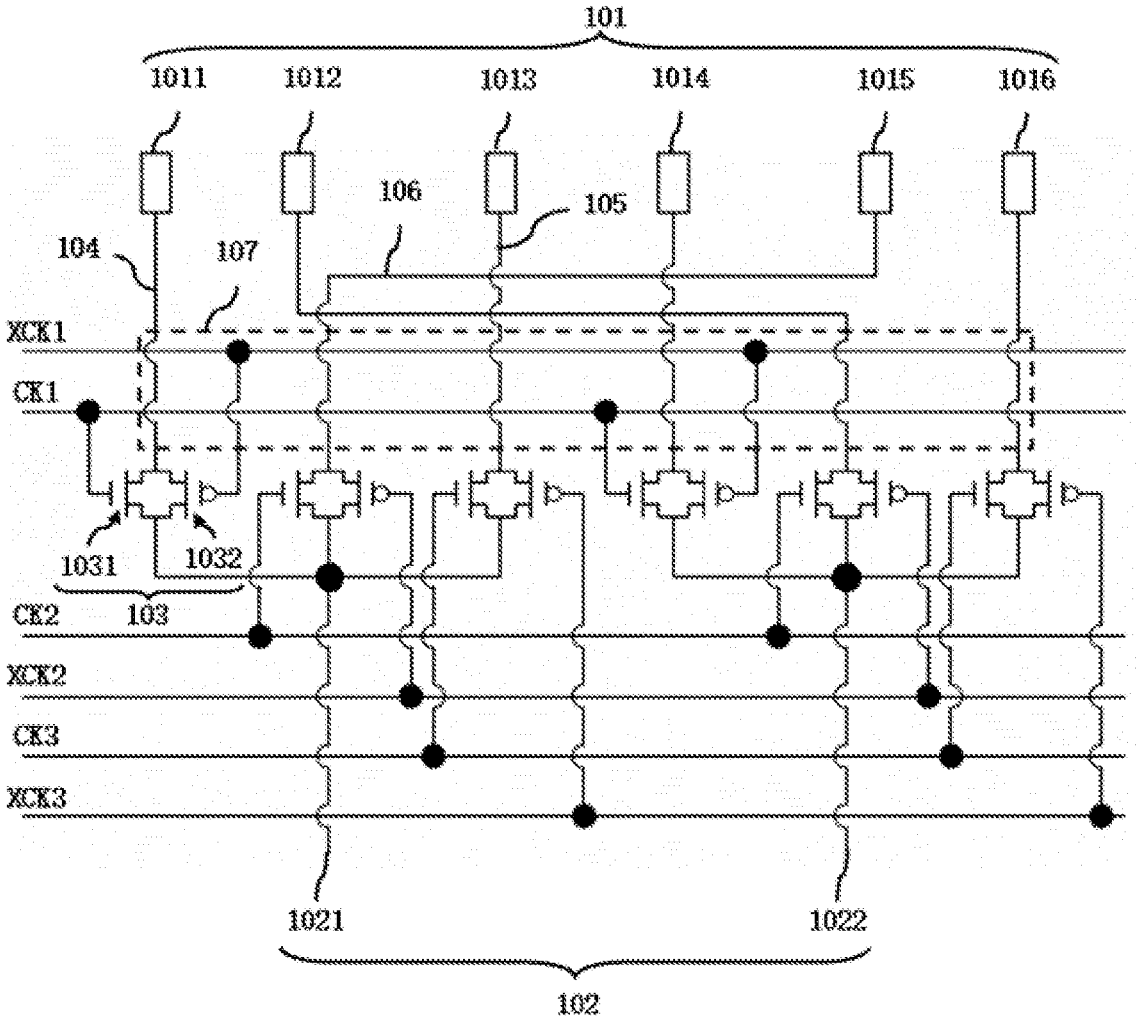
FIG. 1 is a schematic diagram of a display panel according to a first embodiment of the present disclosure.
Figure 2:
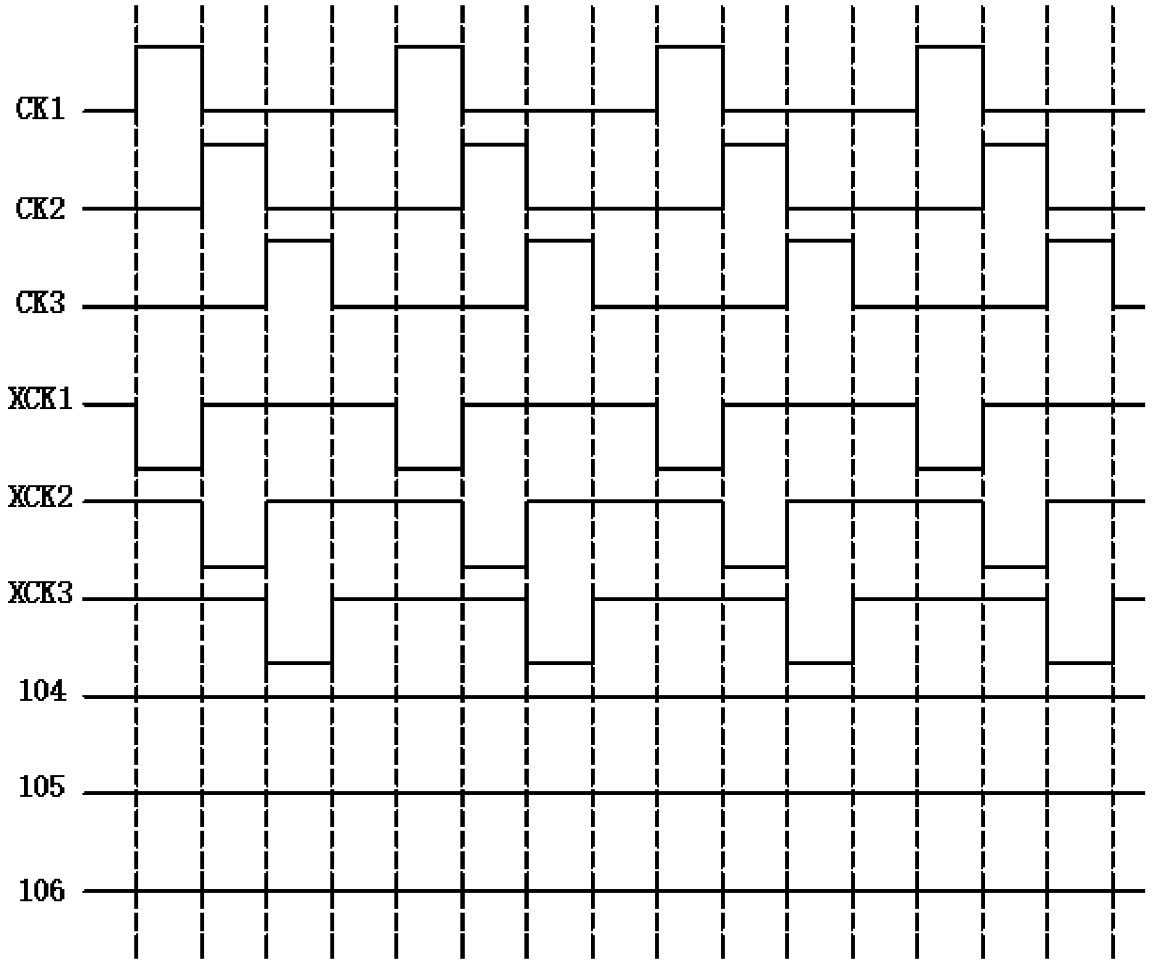
FIG. 2 is a waveform diagram of control signals and data signals transmitted by control line groups and signal transmission lines in the display panel shown in FIG. 1, respectively.

Referring to FIG. 1 and FIG. 2, wherein FIG. 1 is a schematic diagram of a display panel according to a first embodiment of the present disclosure, and wherein FIG. 2 is a waveform diagram of control signals and data signals transmitted by control line groups CK1 and XCK1, CK2 and XCK2, and CK3 and XCK3 and signal transmission lines 104, 105, and 106 in the display panel shown in FIG. 1, respectively.

A display panel in the present embodiment can be a thin film transistor liquid crystal display (TFT-LCD) panel, an organic light emitting diode (OLED) panel, and so on.

The display panel in the present embodiment includes a pixel array 101, a data driving circuit 102, a scan driving circuit, and a de-multiplexing circuit.

The pixel array 101 includes at least one pixel column 1011, 1012, 1013, 1014, 1015, and 1016.

The data driving circuit 102 includes at least one data line 1021 and 1022. The data lines 1021 and 1022 are used to transmit data signals for de-multiplexing.

The scan driving circuit is connected to the pixel array 101.

The de-multiplexing circuit is connected to the pixel array 101 and to the data lines 1021 and 1022. The de-multiplexing circuit includes a de-multiplexing switch group 103, signal transmission lines 104, 105, and 106, and control line groups CK1 and XCK1, CK2 and XCK2, and CK3 and XCK3.

The de-multiplexing switch group 103 is connected to the data lines 1021 and 1022.

Two ends of each of the signal transmission lines 104, 105, and 106 are connected to the de-multiplexing switch group 103 and the pixel columns 1011, 1012, 1013, 1014, 1015, and 1016, respectively. The signal transmission lines 104, 105, and 106 are used to transmit the de-multiplexed data signals.

One of the data lines 1021 and 1022 is connected to two or three de-multiplexing switch groups 103. Two or three de-multiplexing switch groups 103 are connected to two or three of the pixel columns 1011, 1012, 1013, 1014, 1015, and 1016 respectively through two or three of the signal transmission lines 104, 105, and 106.

The control line groups CK1 and XCK1, CK2 and XCK2, and CK3 and XCK3 are connected to the de-multiplexing switch group 103. The control line groups CK1 and XCK1, CK2 and XCK2, and CK3 and XCK3 include first control lines CK1, CK2, and CK3 and second control lines XCK1, XCK2, and XCK3. Voltage levels of a first control signal and a second control signal transmitted by the first control lines CK1, CK2, and CK3 and the second control lines XCK1, XCK2, and XCK3 respectively are opposite to each other. A number of control line groups CK1 and XCK1, CK2 and XCK2, and CK3 and XCK3 that intersect the signal transmission lines 104, 105, and 106 is greater than or equal to zero.

Specifically, in the present embodiment and at the same time, the second control signal is at a low voltage level when the first control signal is at a high voltage level, and the second control signal is at the high voltage level when the first control signal is at the low voltage level.

The control line groups CK1 and XCK1, CK2 and XCK2, and CK3 and XCK3 are disposed at a side of the de-multiplexing switch group 103, near the pixel array 101, and/or at a side of the de-multiplexing switch group 103, away from the pixel array 101.

In response that the number of control line groups CK1 and XCK1, CK2 and XCK2, and CK3 and XCK3 that intersect the signal transmission lines 104, 105, and 106 is greater than zero, the intersection of the signal transmission lines 104, 105, and 106 and the control line groups CK1 and XCK1, CK2 and XCK2, and CK3 and XCK3 is located at the side of the de-multiplexing switch group 103, near the pixel array 101.

The number of control line groups CK1 and XCK1, CK2 and XCK2, and CK3 and XCK3 is two or three.

As shown in FIG. 1, the number of control line groups CK1 and XCK1, CK2 and XCK2, and CK3 and XCK3 is three. A control line group CK1 and XCK1 is disposed at the side of the de-multiplexing switch group 103, near the pixel array 101, and two control line groups CK2 and XCK2, and CK3 and XCK3 are disposed at the side of the de-multiplexing switch group 103, away from the pixel array 101.

That is, the number of control line groups CK1 and XCK1, CK2 and XCK2, and CK3 and XCK3 that intersect the signal transmission lines 104, 105, and 106 is one, and the intersection of the signal transmission lines 104, 105, and 106 and the control line group CK1 and XCK1 is located at the side of the de-multiplexing switch group 103, near the pixel array 101.

The first control line CK1 and the second control line XCK1 are located at the same side of the de-multiplexing switch group 103, and the first control line CK1 is adjacent to the second control line XCK1.

The first control signal and the second control signal, with opposite voltage levels, are used to balance (i.e., offset) a correlation between data signals, transmitted by the data lines 1021 and 1022, due to the intersection of the signal transmission lines 104, 105, and 106 and the control line groups CK1 and XCK1, CK2 and XCK2, and CK3 and XCK3.

Specifically, because the signal transmission lines 104, 105, and 106 intersect the first control line CK1 and the second control line XCK1, a first capacitor is formed between the signal transmission lines 104, 105, and 106 and the first control line CK1, and a second capacitor is formed between the signal transmission lines 104, 105, and 106 and the second control line XCK1.

While the first control signal transmitted by the first control line CK1 changes, electrical charges on a pole plate (i.e., the first control line CK1) of the first capacitor change, and electrical charges on the other pole plate (i.e., the signal transmission lines 104, 105, and 106) of the first capacitor also change. Thus, a derived pulse signal (i.e., a first derived pulse signal) is formed in the signal transmission lines 104, 105, and 106.

For the same reason, while the second control signal transmitted by the second control line XCK1 changes, electrical charges on a pole plate (i.e., the second control line XCK1) of the second capacitor change, and electrical charges on the other pole plate (i.e., the signal transmission lines 104, 105, and 106) of the second capacitor also change. Thus, a derived pulse signal (i.e., a second derived pulse signal) is formed in the signal transmission lines 104, 105, and 106.

Because the signal transmission lines 104, 105, and 106 are used to transmit the de-multiplexed data signals, the first derived pulse signal, the second derived pulse signal, and the data signals are superposed (i.e., multiplexed) and inputted to the pixel columns 1011, 1012, 1013, 1014, 1015, and 1016. At this moment, the first derived pulse signal and the second derived pulse signal affect pictures displayed by the display panel.

In the present embodiment, because the voltage levels of the first control signal and the second control signal transmitted by the first control line CK1 and the second control line XCK1 respectively are opposite to each other, voltage levels of the first derived pulse signal and the second derived pulse signal are opposite to each other. In response that a first de-multiplexing switch 1031 and a second de-multiplexing switch 1032 are both turned on, the first derived pulse signal and the second derived pulse signal, which are superposed on the data signals, offset each other. That is, correlations between the first control signal and the data signals and between the second control signal and the data signals offset each other, preventing the first derived pulse signal and the second derived pulse signal from affecting the pictures displayed by the display panel. In response that the first de-multiplexing switch 1031 and the second de-multiplexing switch 1032 are both turned off, the first derived pulse signal and the second derived pulse signal also offset each other, and thus the pictures displayed by the display panel are also not affected.

In the present embodiment, the de-multiplexing switch group 103 includes the first de-multiplexing switch 1031 and the second de-multiplexing switch 1032.

A first control end of the first de-multiplexing switch 1031 is connected to the first control lines CK1, CK2, and CK3. A second control end of the second de-multiplexing switch 1032 is connected to the second control lines XCK1, XCK2, and XCK3.

A first input end of the first de-multiplexing switch 1031 and a second input end of the second de-multiplexing switch 1032 are both connected to the data lines 1021 and 1022.

A first output end of the first de-multiplexing switch 1031 and a second output end of the second de-multiplexing switch 1032 are both connected to an end of the signal transmission lines 104, 105, and 106.

The first de-multiplexing switch 1031 and the second de-multiplexing switch 1032 are configured to turn on or turn off at the same time in response that the voltage levels of the first control signal and the second control signal are opposite to each other. That is, the first de-multiplexing switch 1031 and the second de-multiplexing switch 1032 simultaneously output the data signals to two of the connected signal transmission lines 104, 105, and 106 respectively or not.

Specifically, the first control end of the first de-multiplexing switch 1031 is directly connected to the first control lines CK1, CK2, and CK3. The second control end of the second de-multiplexing switch 1032 is connected to the second control lines XCK1, XCK2, and XCK3 through a not-gate.

The first de-multiplexing switch 1031 is turned on when the first control signal is at the high voltage level, and the first de-multiplexing switch 1031 is turned off when the first control signal is at the low voltage level.

The second de-multiplexing switch 1032 is turned off when the second control signal is at the high voltage level, and the second de-multiplexing switch 1032 is turned on when the second control signal is at the low voltage level.

One of two control line groups CK1 and XCK1, CK2 and XCK2, and CK3 and XCK3 has a high voltage level waveform and a low voltage level waveform delayed for a predetermined time relative to the other one of the two control line groups CK1 and XCK1, CK2 and XCK2, and CK3 and XCK3.

As shown in FIG. 2, the second group of control line groups, i.e., CK2 and XCK2, has a high voltage level waveform and a low voltage level waveform delayed for the predetermined time relative to the first group of control line groups, i.e., CK1 and XCK1. The third group of control line groups, i.e., CK3 and XCK3, has a high voltage level waveform and a low voltage level waveform delayed for the predetermined time relative to the second group of control line groups, i.e., CK2 and XCK2. At this moment, all of signals transmitted by three signal transmission lines 104, 105, and 106 are not affected by the first control signal and the second control signal.

Figure 3:
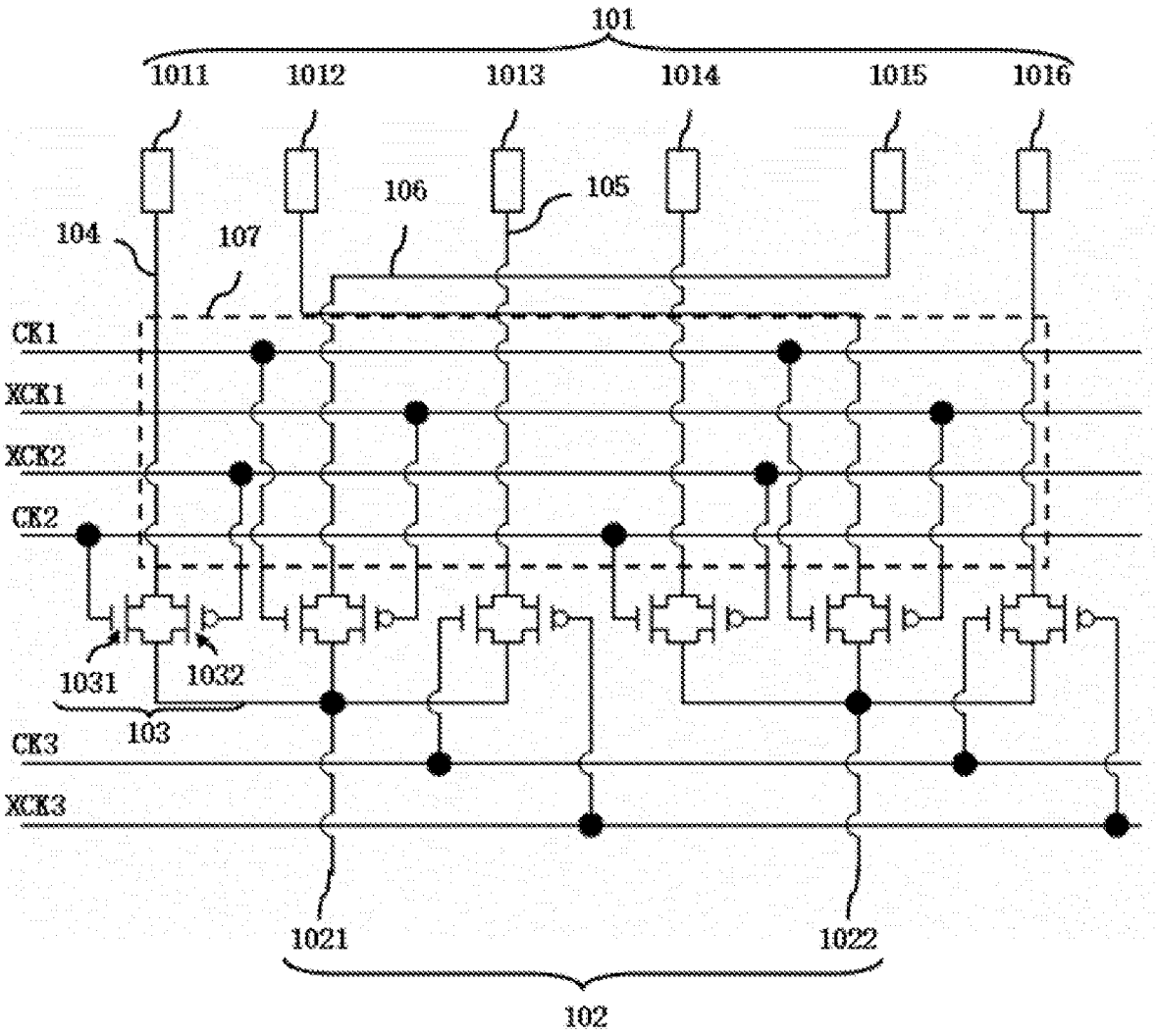
FIG. 3 is a schematic diagram of a display panel according to a second embodiment of the present disclosure.

Referring to FIG. 3, which is a schematic diagram of a display panel according to a second embodiment of the present disclosure. The second embodiment of the present disclosure is similar to the above first embodiment, but their difference is as follows:

In the present embodiment, two control line groups CK1 and XCK1, and CK2 and XCK2 are disposed at the side of the de-multiplexing switch group 103, near the pixel array 101, and a control line group CK3 and XCK3 is disposed at the side of the de-multiplexing switch group 103, away from the pixel array 101.

That is, the number of control line groups CK1 and XCK1, and CK2 and XCK2 that intersect the signal transmission lines 104, 105, and 106 is two, and the intersection of the signal transmission lines 104, 105, and 106, two of the first control lines CK1, CK2, and CK3, and two of the second control lines XCK1, XCK2, and XCK3 is located at the side 107 of the de-multiplexing switch group 103, near the pixel array 101.

At a first time, the first derived pulse signal and the second derived pulse signal, which are generated from intersections of the signal transmission lines 104, 105, and 106 and the first group of control line groups, i.e., CK1 and XCK1, offset each other. At a second time after the predetermined time, another first derived pulse signal and another second derived pulse signal, which are generated from intersections of the signal transmission lines 104, 105, and 106 and the second group of control line groups, i.e., CK2 and XCK2, offset each other.

Figure 4:
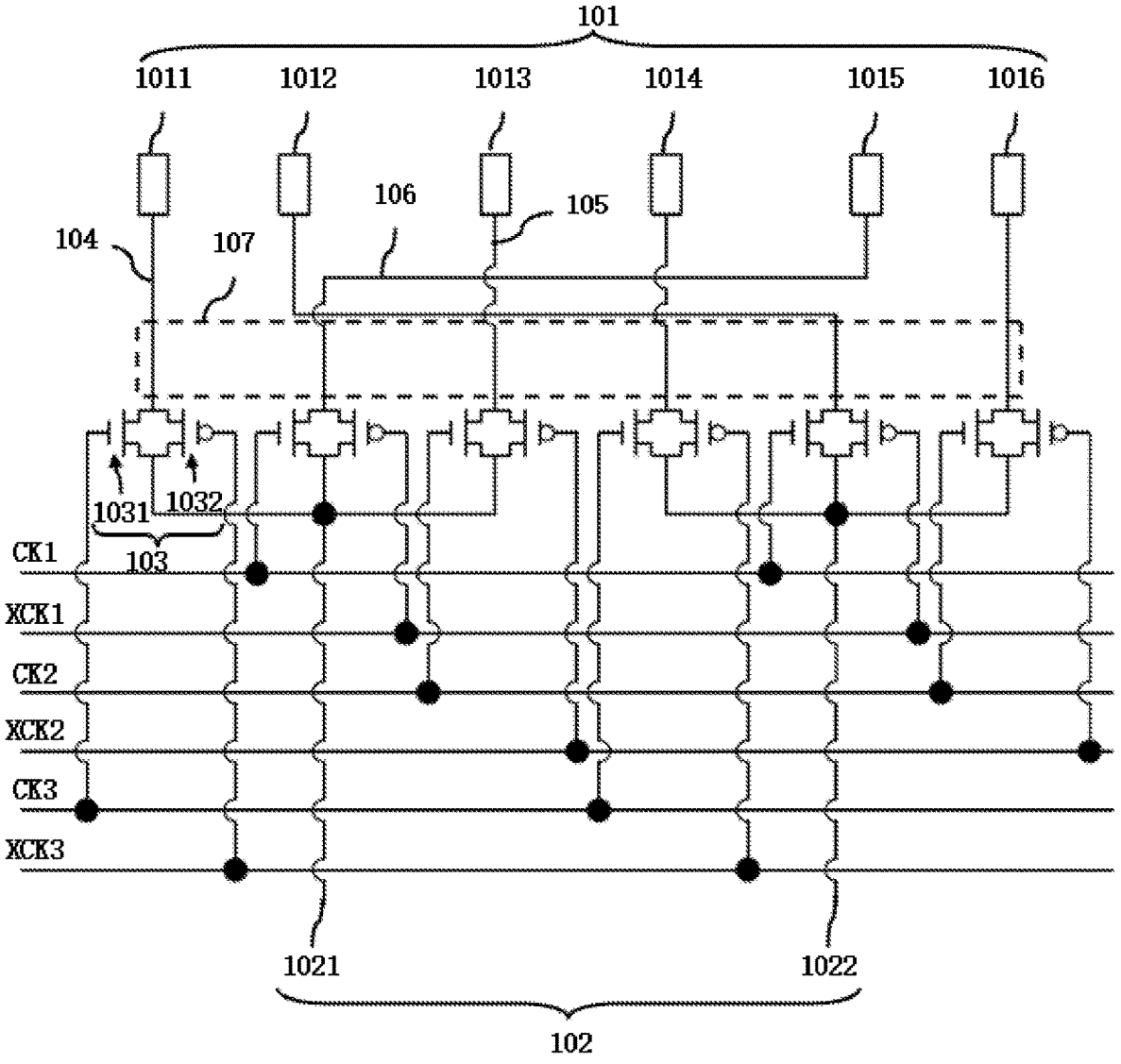
FIG. 4 is a schematic diagram of a display panel according to a third embodiment of the present disclosure.

Referring to FIG. 4, which is a schematic diagram of a display panel according to a third embodiment of the present disclosure. The third embodiment of the present disclosure is similar to the above first embodiment or the second embodiment, but their difference is as follows:

In the present embodiment, a number of control line groups CK1 and XCK1, CK2 and XCK2, and CK3 and XCK3 disposed at the side 107 of the de-multiplexing switch group 103, near the pixel array 101, is zero, and three control line groups CK1 and XCK1, CK2 and XCK2, and CK3 and XCK3 are all disposed at the side of the de-multiplexing switch group 103, away from the pixel array 101.

That is, the number of control line groups CK1 and XCK1, CK2 and XCK2, and CK3 and XCK3 that intersect the signal transmission lines 104, 105, and 106 is zero, and the signal transmission lines 104, 105, and 106 do not intersect any control line.

At this moment, there is no derived pulse signal in the signal transmission lines 104, 105, and 106.

Figure 5:
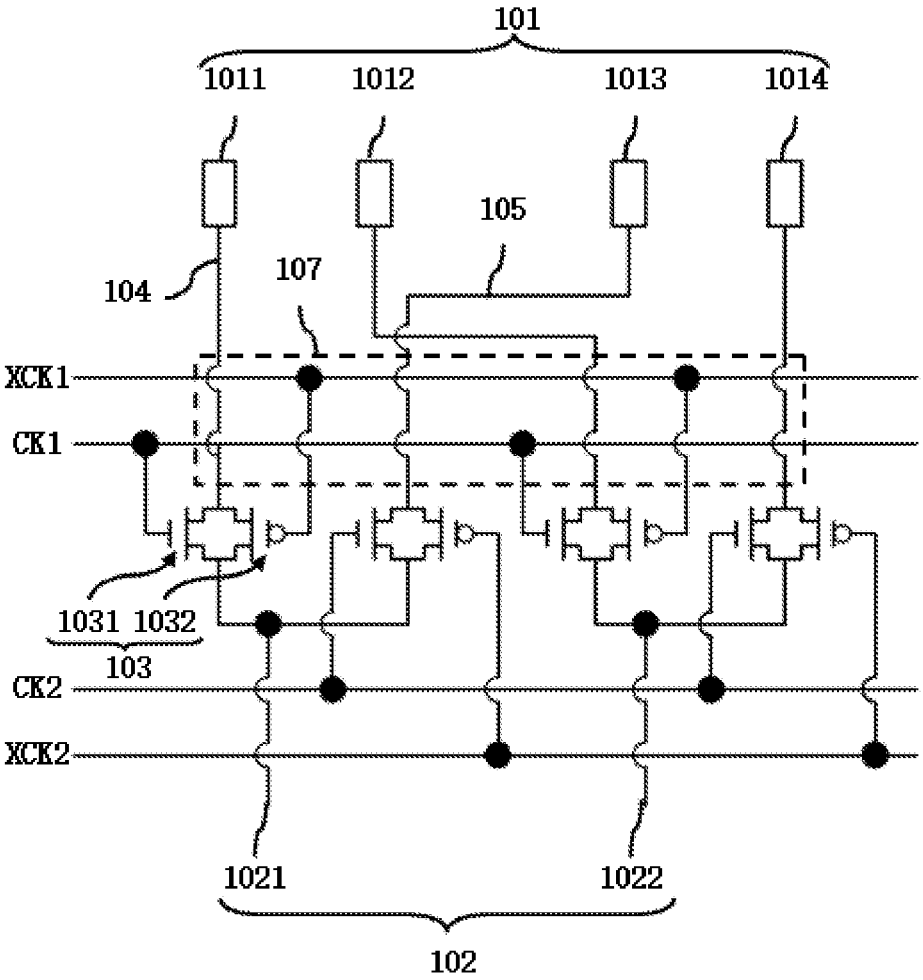
FIG. 5 is a schematic diagram of a display panel according to a fourth embodiment of the present disclosure.

Referring to FIG. 5, which is a schematic diagram of a display panel according to a fourth embodiment of the present disclosure. The fourth embodiment of the present disclosure is similar to the above first embodiment, but their difference is as follows:

In the present embodiment, the number of control line groups CK1 and XCK1, and CK2 and XCK2 is two. A control line group CK1 and XCK1 is disposed at the side 107 of the de-multiplexing switch group 103, near the pixel array 101, and a control line group CK2 and XCK2 is disposed at the side of the de-multiplexing switch group 103, away from the pixel array 101.

That is, the number of control line group CK1 and XCK1 that intersects the signal transmission lines 104, 105, and 106 is one, and the intersection of the signal transmission lines 104, 105, and 106 and the control line group CK1 and XCK1 is located at the side of the de-multiplexing switch group 103, near the pixel array 101.

Figure 6:
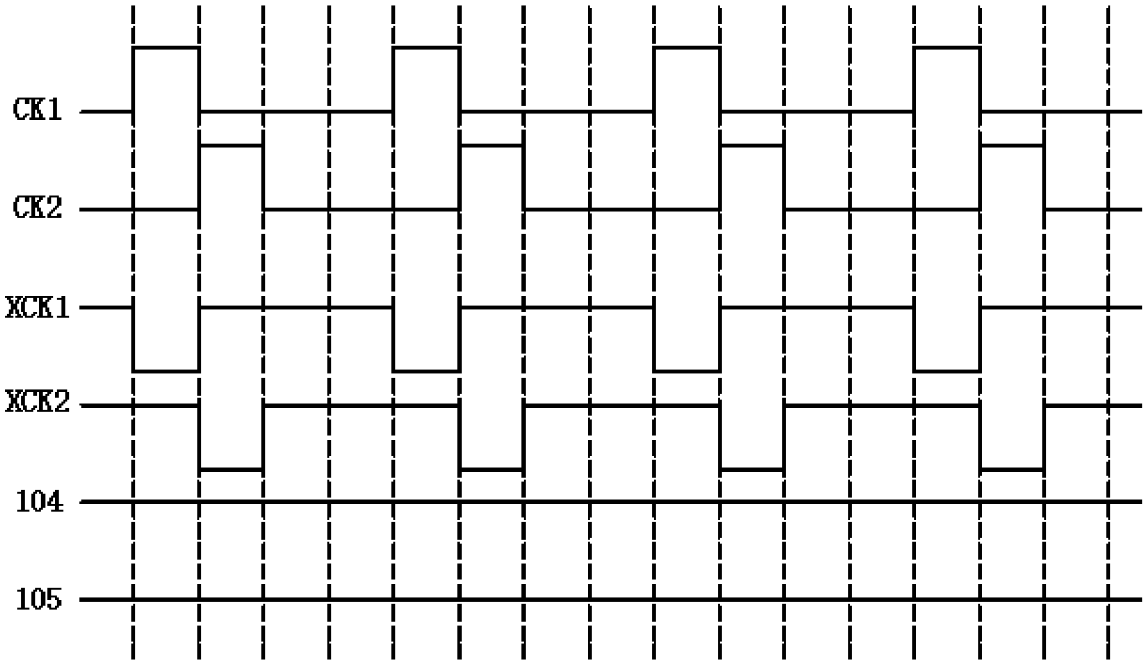
FIG. 6 is a waveform diagram of control signals and data signals transmitted by control line groups and signal transmission lines in the display panel shown in FIG. 5, respectively.

As shown in FIG. 6, the second group of control line groups, i.e., CK2 and XCK2, has a high voltage level waveform and a low voltage level waveform delayed for the predetermined time relative to the first group of control line groups, i.e., CK1 and XCK1. At this moment, both of signals transmitted by two of the signal transmission lines 104, 105, and 106 are not affected by the first control signal and the second control signal.

Figure 7:
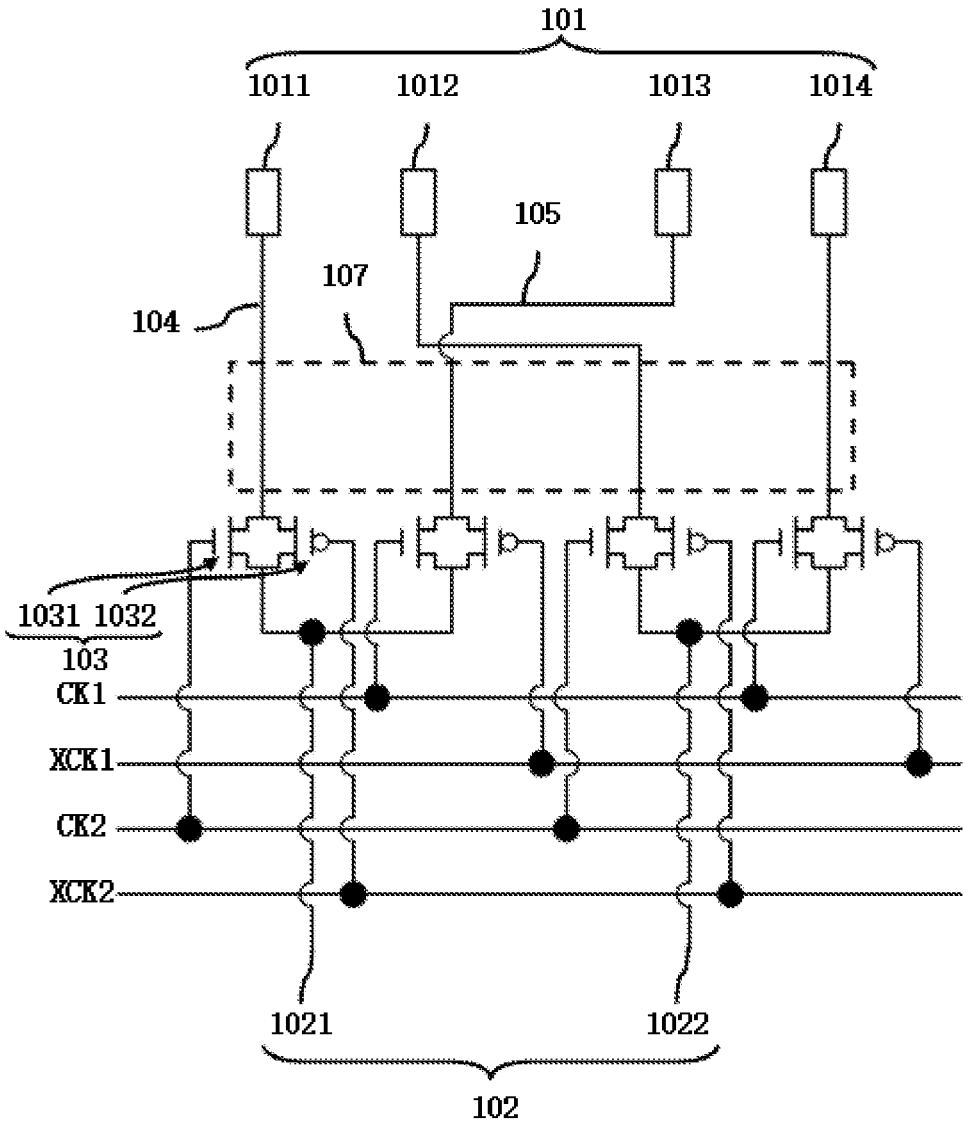
FIG. 7 is a schematic diagram of a display panel according to a fifth embodiment of the present disclosure.

Referring to FIG. 7, which is a schematic diagram of a display panel according to a fifth embodiment of the present disclosure. The fifth embodiment of the present disclosure is similar to the above fourth embodiment, but their difference is as follows:

In the present embodiment, the number of control line groups CK1 and XCK1, and CK2 and XCK2 disposed at the side 107 of the de-multiplexing switch group 103, near the pixel array 101, is zero, and two control line groups CK1 and XCK1, and CK2 and XCK2 are both disposed at the side of the de-multiplexing switch group 103, away from the pixel array 101.

That is, the number of control line groups CK1 and XCK1, and CK2 and XCK2 that intersect the signal transmission lines 104, 105, and 106 is zero, and the signal transmission lines 104, 105, and 106 do not intersect any control line.

At this moment, there is no derived pulse signal in the signal transmission lines 104, 105, and 106.

In the present disclosure, because the voltage levels of the first control signal and the second control signal transmitted by the first control line and the second control line respectively are opposite to each other, and a number of control line groups that intersect the signal transmission line is greater than or equal to zero, a first derived pulse signal, which is resulted in the signal transmission line and which corresponds to the first control signal, is offset by a second derived pulse signal corresponding to the second control signal. Thus, pictures displayed by display panels can be prevented from being affected by derived pulse signals generated from intersections of signal transmission lines and a control line group used to control de-multiplexing switches.

In conclusion, although the present disclosure has been disclosed with reference to the foregoing preferred embodiments thereof, it is not limited to the foregoing preferred embodiments. For those skilled in the art, a variety of modifications and changes may be made without departing from the scope of the present disclosure which is intended to be defined by the appended claims.

What is claimed is:

1. A display panel, comprising:

a pixel array comprising at least one pixel column;

a data driving circuit comprising at least one data line;

a scan driving circuit connected to the pixel array; and a de-multiplexing circuit connected to the pixel array and to the data line, the de-multiplexing circuit comprising:

a de-multiplexing switch group connected to the data line, wherein the de-multiplexing switch group comprises a first de-multiplexing switch and a second de-multiplexing switch;

a signal transmission line, wherein a first output end of the first de-multiplexing switch and a second output end of the second de-multiplexing switch are connected to one same signal transmission line, another end of the signal transmission line is connected to the at least one pixel column, and a first input end of the first de-multiplexing switch and a second input end of the second de-multiplexing switch are connected to one same data line; and a control line group connected to the de-multiplexing switch group, wherein the control line group comprises a first control line and a second control line, wherein voltage levels of a first control signal and a second control signal transmitted by the first control line and the second control line respectively are opposite to each other, and wherein a number of control line groups that intersect the signal transmission line is greater than zero;

wherein the control line group is disposed at a side of the de-multiplexing switch group, near the pixel array, and at a side of the de-multiplexing switch group, away from the pixel array; and wherein voltage levels of the first control signal and the second control signal are opposite, and the first de-multiplexing switch and the second de-multiplexing switch connected to the signal transmission line are turned on or turned off at a same time according to the first control signal and the second control signal, and;

wherein voltage levels of a first derived pulse signal and a second derived pulse signal generated in the signal transmission line are opposite to each other.

2. The display panel of claim 1, wherein the intersection of the signal transmission line and the control line group is located at the side of the de-multiplexing switch group, near the pixel array.

3. The display panel of claim 1, wherein the number of control line groups is two or three.

4. The display panel of claim 1, wherein one of two control line groups has a high voltage level waveform and a low voltage level waveform delayed for a predetermined time relative to one of the two control line groups.

5. A display panel, comprising:

a pixel array comprising at least one pixel column;

a data driving circuit comprising at least one data line;

a scan driving circuit connected to the pixel array; and a de-multiplexing circuit connected to the pixel array and to the data line, the de-multiplexing circuit comprising:

a de-multiplexing switch group connected to the data line, wherein the de-multiplexing switch group comprises a first de-multiplexing switch and a second de-multiplexing switch;

a signal transmission line, wherein a first output end of the first de-multiplexing switch and a second output end of the second de-multiplexing switch are connected to one same signal transmission line, another end of the signal transmission line is connected to the at least one pixel column, and a first input end of the first de-multiplexing switch and a second input end of the second de-multiplexing switch are connected to one same data line; and a control line group connected to the de-multiplexing switch group, wherein the control line group comprises a first control line and a second control line, wherein voltage levels of a first control signal and a second control signal transmitted by the first control line and the second control line respectively are opposite to each other, and wherein a number of control line groups that intersect the signal transmission line is greater than zero; and wherein voltage levels of the first control signal and the second control signal are opposite, the first de-multiplexing switch and the second de-multiplexing switch connected to the signal transmission line are turned on or turned off at a same time according to the first control signal and the second control signal, and;

wherein voltage levels of a first derived pulse signal and a second derived pulse signal generated in the signal transmission line are opposite to each other.

6. The display panel of claim 5, wherein the control line group is disposed at a side of the de-multiplexing switch group, near the pixel array, and at a side of the de-multiplexing switch group, away from the pixel array.

7. The display panel of claim 6, wherein the intersection of the signal transmission line and the control line group is located at the side of the de-multiplexing switch group, near the pixel array.

8. The display panel of claim 6, wherein the number of control line groups is two or three.

9. The display panel of claim 8, wherein in response that the number of control line groups is three, a control line group is disposed at the side of the de-multiplexing switch group, near the pixel array, and two control line groups are disposed at the side of the de-multiplexing switch group, away from the pixel array.

10. The display panel of claim 8, wherein in response that the number of control line groups is three, two control line groups are disposed at the side of the de-multiplexing switch group, near the pixel array, and a control line group is disposed at the side of the de-multiplexing switch group, away from the pixel array.

11. The display panel of claim 8, wherein in response that the number of control line groups is two, a control line group is disposed at the side of the de-multiplexing switch group, near the pixel array, and a control line group is disposed at the side of the de-multiplexing switch group, away from the pixel array.

12. The display panel of claim 5, wherein a first control end of the first de-multiplexing switch is connected to the first control line; and wherein a second control end of the second de-multiplexing switch is connected to the second control line.

13. The display panel of claim 5, wherein the first de-multiplexing switch is turned on when the first control signal is at a high voltage level, and the first de-multiplexing switch is turned off when the first control signal is at a low voltage level; and wherein the second de-multiplexing switch is turned off when the second control signal is at the high voltage level, and the second de-multiplexing switch is turned on when the second control signal is at the low voltage level.

14. The display panel of claim 5, wherein one of two control line groups has a high voltage level waveform and a low voltage level waveform delayed for a predetermined time relative to another one of the two control line groups.

* * * * *